US005703549A

United States Patent [19]

Guidi et al.

[11] Patent Number: 5,703,549

[45] Date of Patent: Dec. 30, 1997

[54] RELAY WITH A MOVABLE ASSEMBLY HAVING A DAMPENING EFFECT

[75] Inventors: Guido Guidi, Frosinone; Giampaolo Boezi, Alatri; Pietro De Filippis, Monza, all of Italy

[73] Assignee: Bitron S.P.A., Cantalupa, Italy

[21] Appl. No.: 383,513

[22] Filed: Feb. 3, 1995

[30] Foreign Application Priority Data

Feb. 4, 1994 [IT] Italy ..... TO94A0060

[51] Int. Cl.[6] ..... H01H 51/22

[52] U.S. Cl. ..... 335/78; 335/105

[58] Field of Search ..... 335/78–86, 124, 335/128, 131, 105

[56] References Cited

U.S. PATENT DOCUMENTS 5,319,331 6/1994 Hirawata et al. ..... 335/80

5,329,265 7/1994 Guidi et al. ..... 335/78

5,394,127 2/1995 Hendel ..... 335/80

*Primary Examiner*—Lincoln Donovan

*Attorney, Agent, or Firm*—Herbert Dubno

[57] ABSTRACT

A relay for use particularly in motor vehicles has a stable ferromagnetic core, an excitation coil wound around the core and a movable assembly, composed by a movable ferromagnetic armature, connected to a blade carrying an electric contact. The blade is movable with respect to the armature and has a fulcrum in an appropriate seat obtained in the armature. The blade is constrained to the armature in an elastic fashion, but is suitable to produce a damping effect on the bouncing phenomenon. The relay also has a return spring to maintain the assembly in a position of maximum air gap with respect to the stable core, when the device is in a release condition, whereby a leaf spring is provided, being fixed in a predetermined point of the movable armature, which constrains for elastic reaction the movement of the movable blade and maintains the desired pressure contact on the electric contact.

3 Claims, 8 Drawing Sheets

RELAY WITH A MOVABLE ASSEMBLY HAVING A DAMPENING EFFECT

FIELD OF THE INVENTION

The present invention relates to a relay, for use particularly in motor-vehicles, comprising a stable ferromagnetic core, an excitation coil wound around said core, a movable assembly composed by a movable ferromagnetic armature, a leaf spring fixed in a determined point of said movable armature and an exchange contact, said relay also comprising a return spring to maintain the armature in a position of maximum air gap with respect to the stable core, when the device is in a release condition.

BACKGROUND OF THE INVENTION

Relays of the above described type are known.

Such relays according to the cited prior art have the drawback that, during the closure phase, the energy accumulated by the movable assembly during the passage from the release position to the working position is only partially damped by the reaction of the mechanical system counteracting the magnetic attraction forces, due to the elastic behavior present in the system itself. The result of said imperfect damping is above all the production of bounces, which cause an early wear of the exchange contacts, due to the repeated closures/openings with high commuted current, but with low pressures of contact.

From U.S. Pat. No. 2,537,052 a relay is known, U.S. Pat. No. 2,517,052 describes a relay comprising a device for frictionally dissipating a part of the kinetic energy being present in the movable parts at the moment of the closure of contacts, so as to minimize the bounces.

This device, however, is bulky and complex, and increases in a considerable manner the weight of the movable assembly, with the resulting deriving drawbacks; in drawbacks in fact, by increasing the mass the benefits of the system which tends to damp the bounces are just lost.

OBJECT OF THE INVENTION

The object of the present invention is to eliminate the drawbacks of the known art and in particular to provide a relay that eliminates the bounces, has a reduced wear of the contacts being lesser than that of the traditional relays and therefore a longer useful life, notwithstanding the fact that it has dimensions and costs being substantially equivalent to those of a traditional relay.

SUMMARY OF THE INVENTION

The relay of the invention for use particularly in motor vehicles, comprises a stable ferromagnetic core, an excitation coil wound around said core, a movable assembly, composed by a movable ferromagnetic armature, connected to a blade carrying an electric contact, and movable with respect to said armature and having a fulcrum in an appropriate seat obtained in the said nature, blade being constrained to the armature in an elastic fashion, but producing a damping effect one the bouncing phenomenon, the relay also comprises a return spring to maintain the movable assembly in a position of maximum air gap with respect to the stable core when the device is in a release condition. A leaf spring is on a predetermined point of said movable armature and drastically constrains the movement of said movable blade and maintains the desired pressure contact on said electric contact.

BRIEF DESCRIPTION OF THE DRAWING

The above and other objects, features, and advantages will become more readily apparent from the following description, reference being made to the accompanying drawing in which.

SPECIFIC DESCRIPTION

Normally, relays of the type of those herein described are used in motor vehicles. All such relays have substantially a structure having a ferromagnetic core, an excitation coil and at least one movable armature or keeper.

Figure 1:
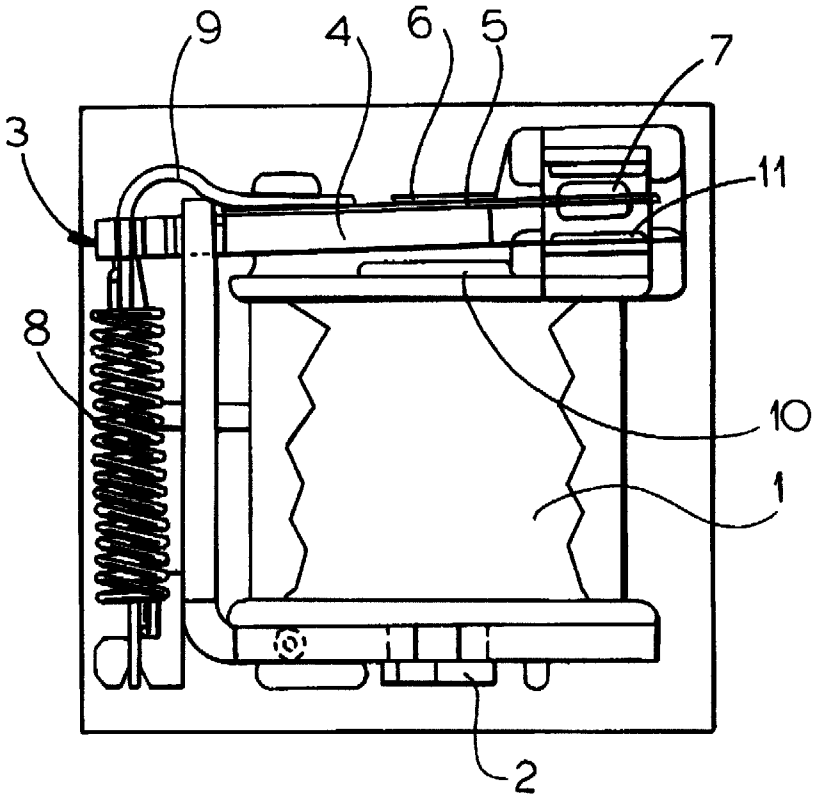
FIG.1 PRIOR ART
FIG. 1 is a schematic plan view of a relay of the known type.

In FIG. 1 a traditional relay, of the type used in motor vehicles, is schematically represented.

An excitation coil is wound around a stable core 2. The movable assembly 3 is composed by:

a movable ferromagnetic, indicated with reference number 4;

a leaf spring 5, the movable armature 4 at 6; and an electric exchange contact 7.

A return spring 8 maintains the armature 4 in the position of maximum air gap with respects to the core 2 when the device is in a release condition. Reference number 9 indicates a braided conductor for the electric connection to the contact 7 and reference number 10 indicates a support point for the movable armature 4, when the relay is in the working position. Reference number 11 indicates an electric closure contact, which is activated when the movable armature 4 is attracted by the core 2.

In the devices of the illustrated type, an interaction takes place between a force that is created by the excitation of a variable reluctance magnetic circuit and the corresponding reaction of the mechanical system; for further details on the operation of such devices, see for instance the contents of the Italian patent application No. TO92A000434, filed in the name of the same Applicant, or the corresponding U.S. Pat. No. 5,329,265.

Figure 3:
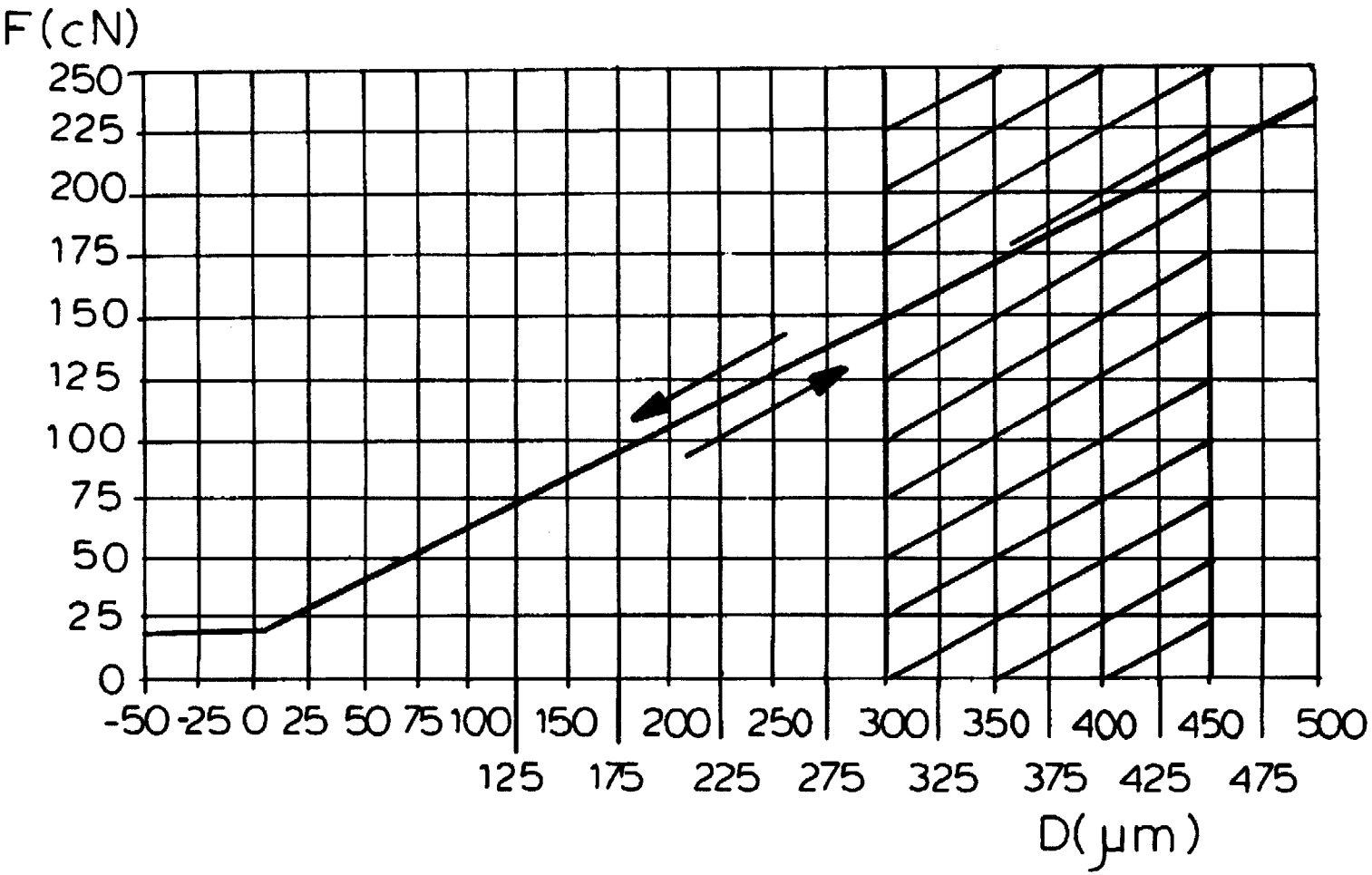
FIG.3 PRIOR ART
FIG. 3 is a diagram of the elastic characteristic of the movable assembly of a relay of the known type, along the a Cartesian system having in abscissa the displacement value, being expressed in microns, and along the ordinate the value of the force detected at each displacement, expressed in centinewton.

FIG. 3 shows the typical elastic characteristic of the movable assembly 3 of a relay of the type described in FIG. 1, in a system of Cartesian axes having along the abscissa the displacement value, expressed in microns, and along the ordinate the value of the force detected at each displacement, expressed in centinewton. The portion being highlighted in the diagram of FIG. 3 represents the foreseen field of work.

In other words, the diagram of FIG. 3 represents the mechanical gradient "force-displacement" in "the outward journey" (i.e. from the first union of the exchange contacts to the condition of foreseen maximum deformation) and in "the return" (i.e. from the position of foreseen maximum deformation to the position of first union of the exchange contacts) relative to the movable assembly of a relay of the known type.

From the moment of the first electric contact up to the foreseen maximum deformation in the working position ("outward journey"), the mechanical system passes from a null force to the maximum force foreseen on the contact 10. By running backwards, i.e. from the point of maximum work to the point of null force ("return"), we can notice an almost perfect superposing of said measure with the preceding one. This is due to the fact that this component is an elastic element and behavior variations do not exist in applying or in eliminating a force on the system. In other words, therefore, in the relay according to the known art no damping of kinetic energy takes place during the transitory phases of closure.

This is the main reason for the bounces which are present in transitory closure of the contacts on the relays of known type.

Figure 2:
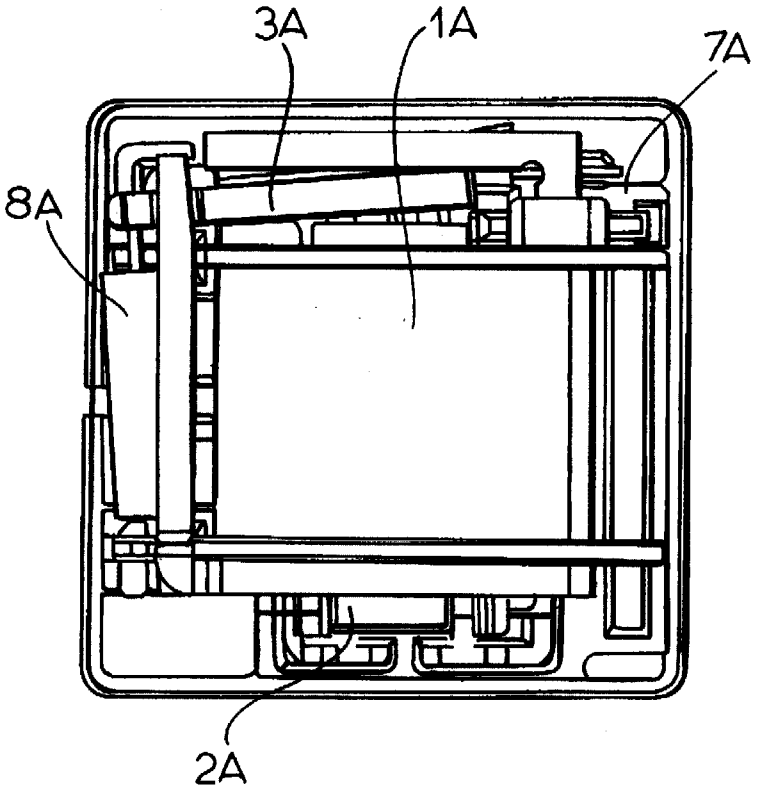
FIG. 2 is a plan view of a relay according to the invention.
Figure 2B:
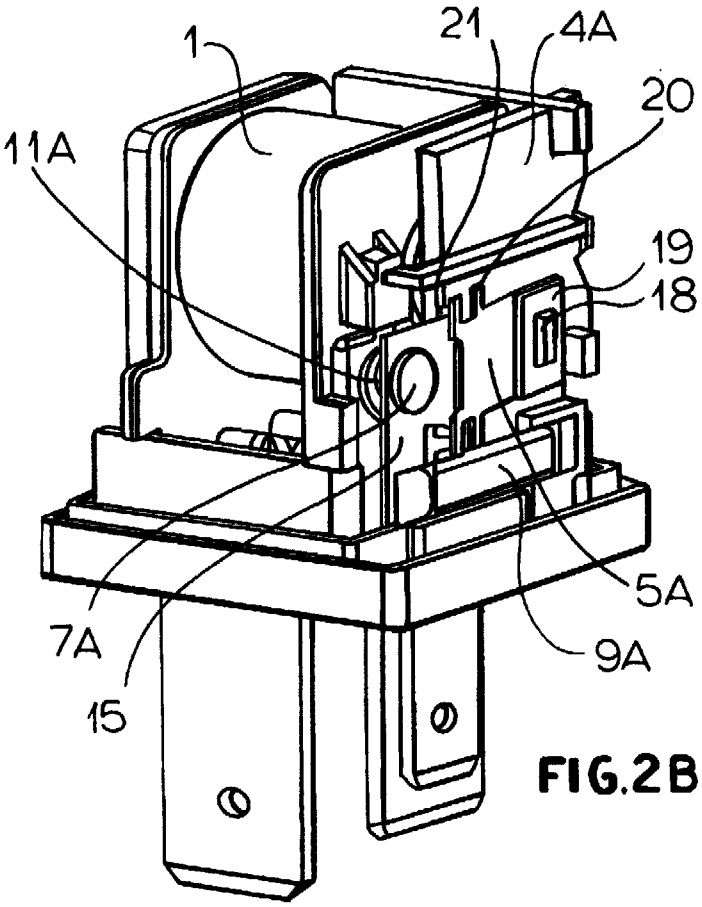
FIG. 2B is a perspective view of a relay according to the invention.
Figure 2A:
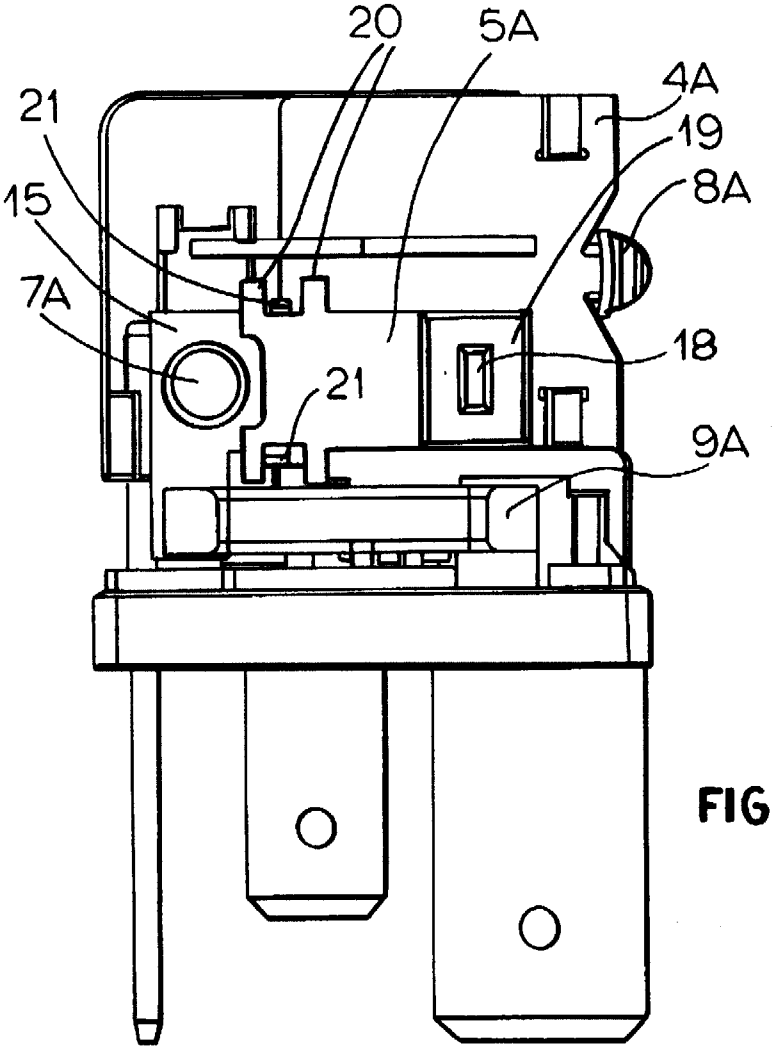
FIG. 2A is a side view of a relay according to the invention.
Figure 2D:
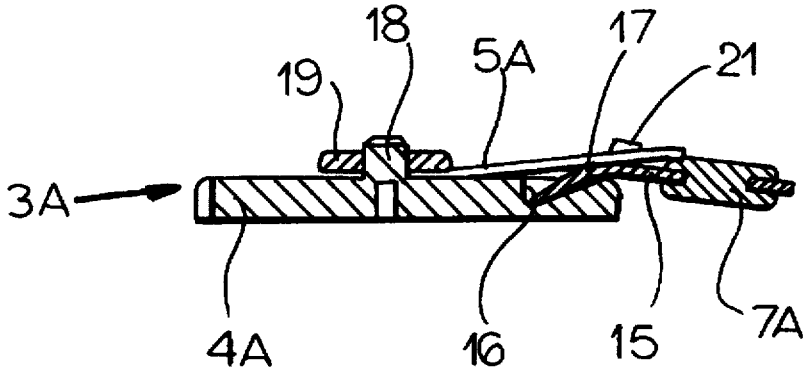
FIG. 2D is a section through the armature of the relay of FIG. 2.

In FIGS. 2, 2A and 2B a relay according to the invention is schematically represented. The parts in common with the relay of FIG. 1 are indicated with the same reference numbers, with the addition of the letter A.

According to the invention, the movable assembly 3A is equipped a movable blade 15, suitably shaped, which has its fulcrum in a suitable seat 16 formed in the movable armature 4A. In particular the movable blade 15 has a bent portion 17 inserted in the seat 16 forming an angle with regard to the main portion which at its opposite end has an exchange contact 7A. The seat 16 can be advantageously obtained by making a notch on the movable armature 4A. At 18 a shield of the nature 4A is indicated and at 19 there is an element for the fixing, onto the relief 18, a leaf spring 5A. The leaf spring 5A has guides 20, within which two small shoulders 21 are inserted, for limiting the movements, the shoulders being formed on the movable blade 15.

Figure 2C:
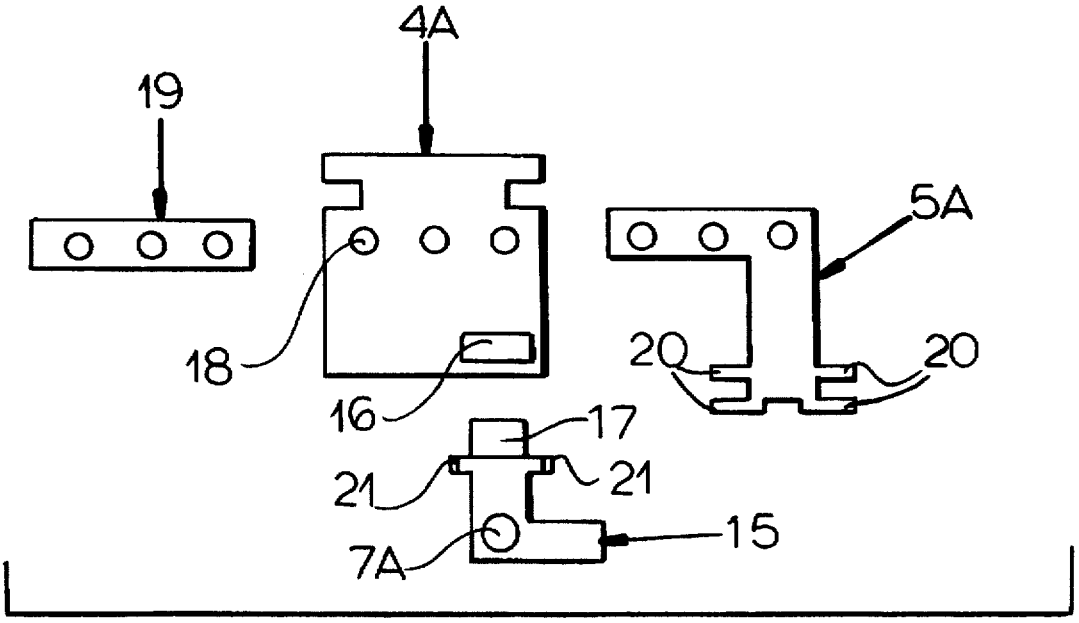
FIG. 2C is an exploded view of the component parts of the movable assembly of a relay according to the invention, in a particularly advantageous embodiment.

As it can be seen from FIGS. 2, 2A, 2B and 2D, the movable blade is limited in its possibilities of movement by the leaf spring 5A which, due to the elastic reaction generated on the contact point and to the shoulders 21 being inserted in the suitable guides 20, limits the degree of freedom of the movable blade 15 itself, and transfers to it, and precisely at its reflex where its two portions meet up, the forces being necessary for assuring a closure of the exchange contact 7A. In FIG. 2C there are illustrated in plan view the components of the movable assembly of a relay according to the invention in an embodiment which is an alternative to that shown in FIGS. 2A and 2B, wherein three reliefs 18 are provided. As can be imagined from the figures, the inclined portion 17 of the movable blade 15 is inserted in the seat 16 of the armature 4A, the leaf spring 5A is inserted on the reliefs 18 so as that the shoulders 21 are restrained in the guides 20, and finally the element 19 is fixed on the reliefs 18, in order to make the leaf spring 5A to the armature 4A with the blade 15 being interposed. The leaf spring 5A is therefore permanently in flexion for maintaining in a constrained position the movable blade 15.

The presence of a condition of elastic deformation of the leaf spring 5A on the movable assembly realized according to what is being illustrated in FIGS. 2A, 2B or 2C creates an elastic characteristic which can be schematically defined as "segmented", as described greater in the previously cited Italian patent application, with all the advantages already cited in said document.

The main innovation of the relay according to the invention, is however due to the presence of a mechanical "hysteresis" on the group of the movable assembly, due to its particular configuration according to the invention. This hysteresis damps the kinetic energy accumulated during the transitory closure (i.e. in the portion of time necessary to the relay for passing from the release position to the working position) and annuls bounces which are generated on the system for dampening the kinetic energy not damped by the mechanic model.

Figure 4:
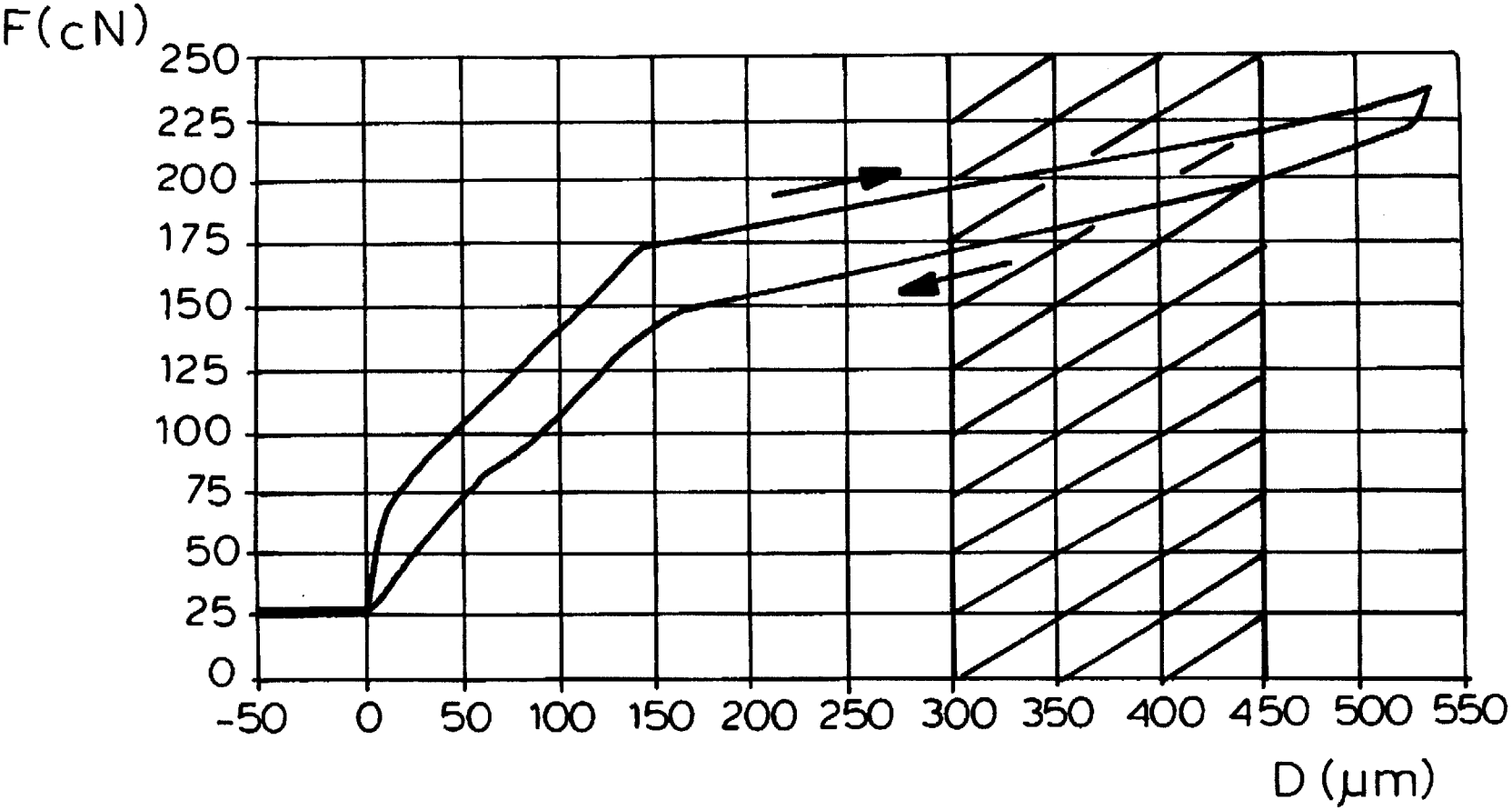
FIG. 4 is a diagram similar to that of FIG. 3, the elastic characteristic being typical of a relay realized according to the invention.

FIG. 4 shows the elastic characteristic typical for the movable assembly of a relay according to the invention, in a system of Cartesian coordinates having along the abscissa the displacement value, expressed in microns, and along the ordinate the value of the force detected at each displacement, expressed in centinewton. The diagram of FIG. 4 therefore represents the mechanical gradient "force-displacement" in "the outward journey" (i.e. from the first union of the exchange contacts to the condition of foreseen maximum deformation) and in "the return" (i.e. from the position of foreseen maximum deformation to the position of first union of the exchange contacts) relative to the movable assembly of a relay according to the invention. As can be seen, from the moment of the first electric contact up to the foreseen maximum deformation in the working position ("outward journey"), the mechanical system passes from a zero force to the maximum force foreseen on the contact 11A. By running backwards, i.e. from the point of maximum work to the point of null force ("return"), we can however notice that, contrary to what has been illustrated in FIG. 3 (notwithstanding the fact that the force value are equivalent to those of FIG. 3), the device according to the invention has a loss of charge, or loss of acquired force, of about the 10% in respect of the value measured during the closure phase (said value is a parameter of the project which can be redefined depending upon the functional necessities provided on the particular). This is due to the fact that, components is an elastic element, but has parts in reciprocal movement resulting in a loss of force which can be calculated, and is caused by the friction being present on the system. This portion of force, suitably dimensioned, allows for the total damping of the bounces present on the contacts during the closure phases, with the consequent increase of the useful life of the component itself.

In other words, the sliding of the movable blade 15 on the fulcrum point on the armature 4A and the pressure discharged by the elastic leaf spring 5A on the movable blade in the angled point of the same, generate a friction capable of damping a part of the force being necessary for the displacement.

Figure 5:
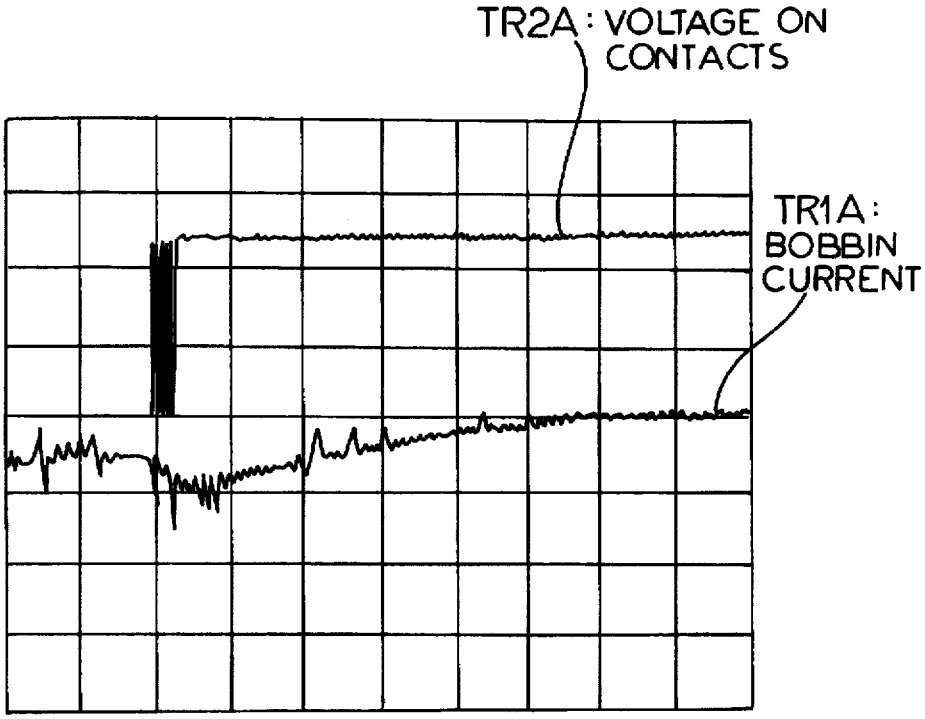
FIG.5 PRIOR ART
FIG. 5 is an illustration of the oscilloscope pattern of the bounces being present during the closure of a relay of the known type.
Figure 6:
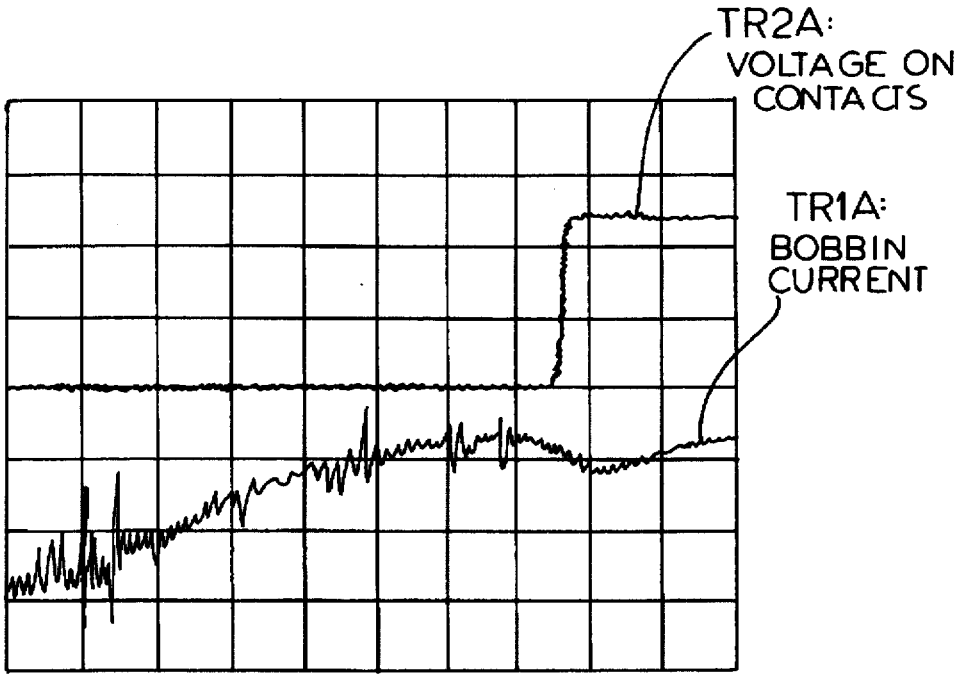
FIG. 6 is an illustration of the oscilloscope pattern of the bounces being present during the closure of a relay according to the invention.

From what has been described, it results that the movable assembly of the relay according to the invention presents a portion of force being generated by the friction among the parts in related movement apt at dampening the acquired energy, so as to annul the bounces on the contacts and, therefore, to lengthen the useful life of the components; the comparisons of the diagram of FIG. 5 (known relay) with the diagram of FIG. 6 (relay according to the invention) certifies that what above said is obtained.

In particular, the zone indicated by the arrow in FIG. 5 highlights the moment of voltage closure on the contacts of a relay of the type of that illustrated in FIG. 1: as it can be seen the arrow shows at least four closures, i.e, the cited bounces; on the contrary, in the case of FIG. 6, it can be seen how in the relay according to the invention only one closure is obtained, without any bounces.

Another important feature which has to be underlined of the relay realized according to the present invention is that, under a parity of displacement of the contact 7A in the closure moment, a translation of the contact point is verified, being greater than that which can be noticed in the relay according to the prior art.

Figure 7:
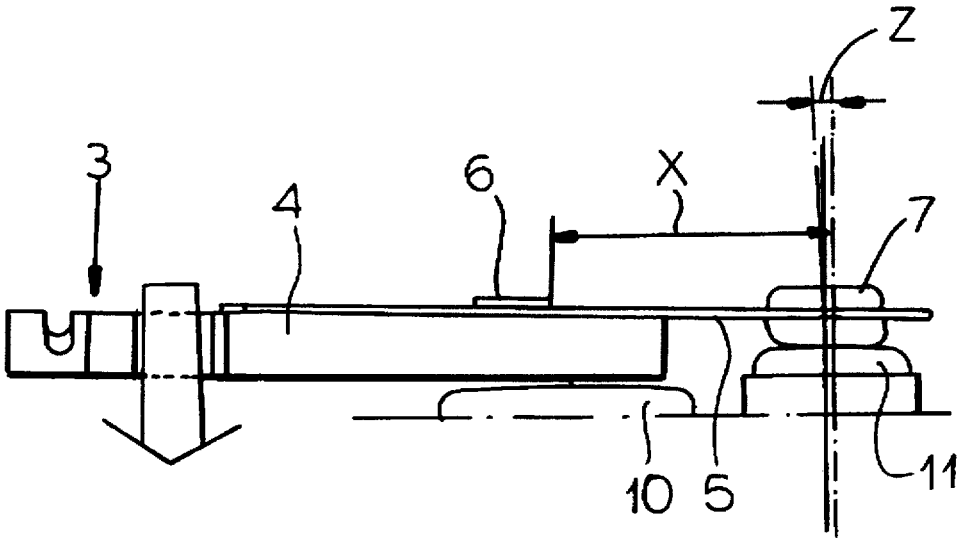
FIGS. 7 and 7A schematically represent the involved in the tangential force component (difference between the first electric contact point and the contact point at the completed magnetic closure) in a relay of the known type.
Figure 7A:
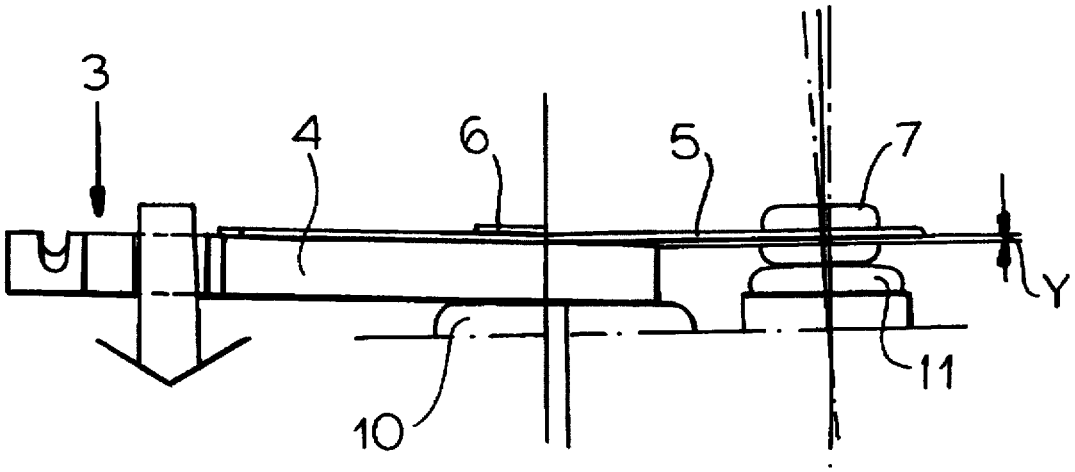
Figure 8:
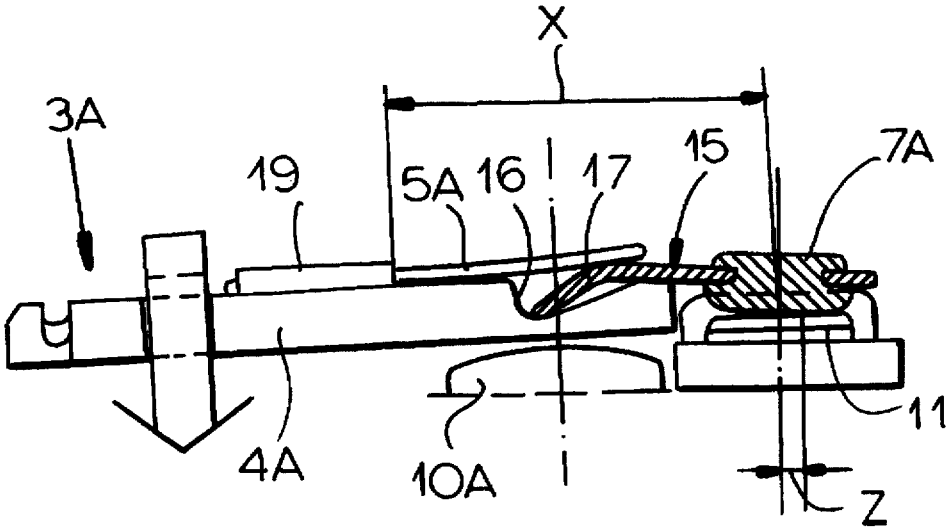
FIGS. 8 and 8A schematically show the portion of the contact involved difference between the first electric contact point and the contact point at the completed magnetic closure) in a relay according to the invention.
Figure 8A:
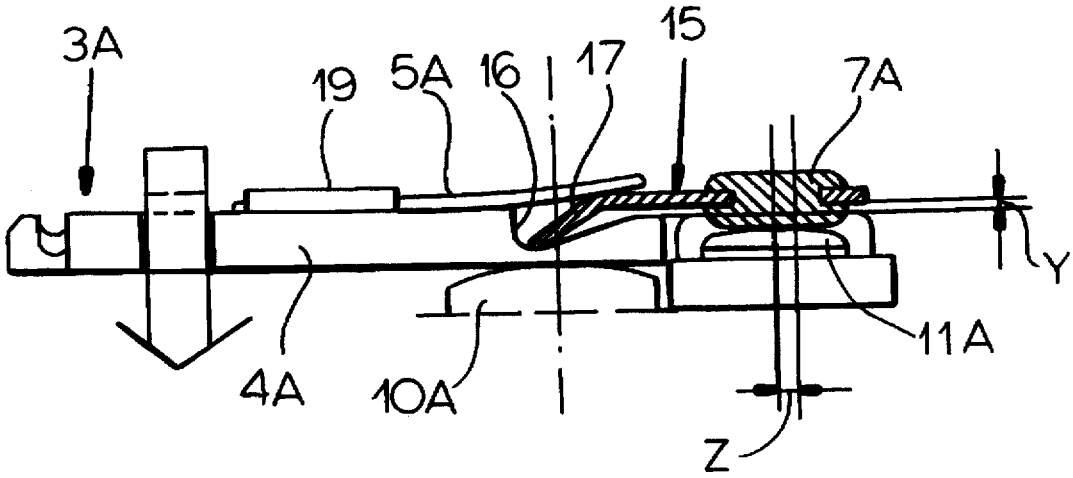

In fact, as it can be seen by the comparison of FIGS. 7–7A (prior art) and 8–8A (present invention), under a parity of other conditions (see quotes X and Y), the use of the movable blade 15 allows to increase the contact portion being interested by the component of force tangential to the contact surfaces: in the illustrated specific case an increment of about 40% is obtained of the zone interested by a component of tangential force (see quotes Z): in this way it is therefore generated a "self-cleaning" system for the surfaces of the same contacts 7A, 11A, due to the sliding of the surface of the contact 7A over the surface of the contact 11A, which allows the removal of "micro-peaks" and the levelling of the "micro-craters" which, being formed on the contact surfaces during operation, cause the possibility of jamming of the contacts.

It should then be noticed that in the relay realized according, to the present invention, the use of a condition of elastic deformation of the leaf spring 5A allows to obtain the same advantages as described in the above cited Italian patent application, and in particular a closure of the contact with sufficient force to commute currents of a powerful starting point, as those obtained in the closure on very low initial resistance charges.

It should also be noticed that the present invention can be used on a relay having a normally closed contact; in said application, in the release position an elastic feature of the movable assembly is obtained, being equivalent to that existing on the working contact, with all the advantages applicable to the working condition which can be foreseen on the release contact, with the only reduction of the effects caused by the fact that, for its own nature, a relay of the normally closed type has a contact pressure (therefore a model of working forces) being lower on the release contact.

From the given description the features and the advantages of the present invention become therefore clear; namely the relay according to the invention shows a wear of the contacts being minor to that of the traditional relay, and therefore a longer useful life: this is obtained by means of the reduction of the bounces and by means of the above described self-cleaning system.

It is clear that several changes can be made to the relay subject of the present invention, for instance by inverting the functions among the different interested elements or replacing the constructive elements shown in the figures with simple technical equivalents; for instance the shape and the arrangement of the connection plait 9A could be different of that illustrated as an example, and being suitable chosen in order to contribute to the dampening effect and avoid resonance in the relay operation.

We claim:

1. A relay suitable for use in a motor vehicle comprising:

a ferromagnetic core;

an excitation coil surrounding said core;

an armature assembly mounted so as to be movable relative to said core and comprising:

an armature juxtaposed with said core and attracted toward said core from a position in which said armature forms a maximum gap with said core, said armature having a recess at an end thereof, a bent blade having one end formed as a fulcrum and engaged in said recess and an opposite end formed as a movable contact, a leaf spring having one end bearing upon said blade and overlying said blade, and means for anchoring said leaf spring at a location spaced from said end of said leaf spring to said armature, a coil spring acting upon an opposite end of said armature for drawing said armature into said position; and a pair of fixed contacts straddling said movable contact and selectively engaged by said movable contact upon excitation and de-excitation of said coil with pivoting of said blade about said fulcrum and damping of bounce by said movable contact with said leaf spring.

2. The relay defined in claim 1 wherein said leaf spring has a pair of lateral guides and said blade has respective shoulders received in said guides.

3. The relay defined in claim 2 wherein said for anchoring includes at least one projection formed on said armature and at least one hold formed in said leaf spring and fitted over the projection.

* * * * *